US010731287B2

(12) United States Patent
Heater et al.

(10) Patent No.: US 10,731,287 B2
(45) Date of Patent: Aug. 4, 2020

(54) BI-DIRECTIONAL DOOR FOR AN APPLIANCE

(71) Applicant: WHIRLPOOL CORPORATION, Benton Harbor, MI (US)

(72) Inventors: Timothy E. Heater, Hartford, MI (US); Nicholas E. Mawhorr, Granger, IN (US); Jaroslav Ridilla, Poprad (SK); Justin Zirbes, Bristol, CT (US)

(73) Assignee: Whirlpool Corporation, Benton Harbor, MI (US)

( * ) Notice: Subject to any disclaimer, the term of this patent is extended or adjusted under 35 U.S.C. 154(b) by 182 days.

(21) Appl. No.: 15/815,132

(22) Filed: Nov. 16, 2017

(65) Prior Publication Data

US 2019/0145142 A1 May 16, 2019

(51) Int. Cl.

| | |
|---|---|
| ***D06F 39/14*** | (2006.01) |
| ***E05D 15/50*** | (2006.01) |
| ***E05D 7/02*** | (2006.01) |

(52) U.S. Cl.

CPC ..... *D06F 39/14* (2013.01); *E05D 7/02* (2013.01); *E05D 15/502* (2013.01); *E05D 15/505* (2013.01); *E05Y 2900/30* (2013.01); *E05Y 2900/312* (2013.01)

(58) Field of Classification Search

CPC ..... E05D 15/05; E05D 15/502; E05D 15/505; E05D 7/02; E05Y 2900/312; D06F 37/28; D06F 39/14

See application file for complete search history.

(56) References Cited

U.S. PATENT DOCUMENTS

| | | | | |
|---|---|---|---|---|
| 2,885,723 | A | 5/1959 | Altmann | |
| 3,321,100 | A | 5/1967 | Toma | |
| 4,495,673 | A | 1/1985 | Khan | |
| 4,503,582 | A | 3/1985 | Gurubatham | |
| 4,532,673 | A | 8/1985 | Kim | |
| 5,133,153 | A * | 7/1992 | Kamitaka | E05D 15/505 49/501 |

(Continued)

FOREIGN PATENT DOCUMENTS

| | | | |
|---|---|---|---|
| AU | 2011345513 | A1 | 7/2013 |
| AU | 2011345515 | A1 | 7/2013 |

(Continued)

OTHER PUBLICATIONS

Machine translation of DE-102009044126-B3, dated Nov. 2010. (Year: 2010).*

*Primary Examiner* — Michael E Barr
*Assistant Examiner* — Kevin G Lee
(74) *Attorney, Agent, or Firm* — McGarry Bair PC

(57) ABSTRACT

A laundry treating appliance can include a chassis defining an interior, with a tub and a drum provided in the interior to define a treating chamber for treating articles according to a cycle of operation. A door can selectively open an access opening in the chassis for accessing the treating chamber. The door can include a hinge assembly having a first hinge arm and a second hinge arm coupled to an actuator arm. Operation of a handle assembly can actuate the actuator arm and can selectively couple the first hinge arm at a first hinge or the second hinge arm at a second hinge to open the door in a first or second direction.

17 Claims, 11 Drawing Sheets

(56) References Cited

U.S. PATENT DOCUMENTS

| | | | | |
|---|---|---|---|---|
| 5,222,792 | A * | 6/1993 | Kai | E05D 15/502 312/406 |
| 5,675,934 | A | 10/1997 | Park | |
| 5,829,197 | A | 11/1998 | Oh | |
| 7,165,800 | B2 | 1/2007 | Thiele et al. | |
| 7,201,422 | B2 | 4/2007 | Plett et al. | |
| 7,258,373 | B2 | 8/2007 | Plett et al. | |
| 7,481,479 | B1 | 1/2009 | Townson et al. | |
| 7,516,515 | B2 | 4/2009 | Leimkuehler et al. | |
| 8,523,300 | B2 | 9/2013 | Najera Bernal et al. | |
| 8,729,439 | B2 | 5/2014 | Kim | |
| 8,757,741 | B2 | 6/2014 | Najera Bernal et al. | |
| 8,820,861 | B2 | 9/2014 | Kim et al. | |
| 8,936,330 | B2 | 1/2015 | Kim et al. | |
| 9,163,347 | B2 | 10/2015 | Yang | |
| 9,435,068 | B2 | 9/2016 | Kang et al. | |
| 9,458,565 | B2 | 10/2016 | Kim et al. | |
| 2011/0023559 | A1 | 2/2011 | Schone | |
| 2014/0375189 | A1 * | 12/2014 | Kim | D06F 39/14 312/228 |
| 2016/0076187 | A1 * | 3/2016 | Lee | D06F 37/28 312/228 |
| 2016/0348299 | A1 | 12/2016 | Kang et al. | |

FOREIGN PATENT DOCUMENTS

| | | | | |
|---|---|---|---|---|
| CN | 203755041 | U | 8/2014 | |
| DE | 102009044126 | B3 * | 11/2010 | E05D 15/505 |
| EP | 2657393 | A2 | 10/2013 | |
| EP | 2657394 | A2 | 10/2013 | |
| KR | 20040006241 | A | 1/2004 | |
| WO | 2012087055 | A3 | 10/2012 | |
| WO | 2012087057 | A3 | 10/2012 | |
| WO | 2015130247 | A1 | 9/2015 | |

* cited by examiner

BI-DIRECTIONAL DOOR FOR AN APPLIANCE

BACKGROUND

Laundry treating appliances, such as clothes washers, refreshers, and non-aqueous systems, have a treating chamber for treating articles according to a cycle of operation. The treating chamber is accessible through an access opening, selectively closed by a door. Traditionally, the door opens in a single direction, requiring particular positioning or organization of the appliance in order to facilitate use at the access opening based upon the opening direction of the door. Some appliances permit switching the direction in which the door opens, but require manufacturer maintenance and replacement, or reorganization of parts to switch which direction the door opens, increasing costs and time. Furthermore, it is inconvenient to the consumer.

BRIEF SUMMARY

In one aspect, the disclosure relates to a household appliance including a chassis defining an interior having an access opening and a door selectively closing the access opening. A first hinge assembly includes a first pair of hinge plates mounted to the chassis and door, respectively, and collectively forming a first knuckle with a first hinge pin received within the first knuckle to define a first axis of rotation. A second hinge assembly includes a second pair of hinge plates mounted to the chassis and door, respectively, and collectively forming a second knuckle, with a second hinge pin received within the second knuckle to define a second axis of rotation for the door, which is different from and spaced from the first axis of rotation. An actuator arm couples to both the first and second hinge pins, and is operable between a first fixed state, where the first hinge pin is received within the first knuckle and the second hinge pin is withdrawn from the second knuckle, and a second fixed state where the second hinge pin is received within the second knuckle and the first hinge pin is withdrawn from the first knuckle. The actuator arm stays in one of the first and second fixed states throughout its operation until the other of the first and second fixed states is actuated.

In another aspect, the disclosure relates to a door assembly for a household appliance having a chassis including an access opening. The door assembly includes a first hinge assembly including a first pair of hinge plates forming a first knuckle, with a first hinge pin received within the first knuckles to define a first axis of rotation. A second hinge assembly includes a second pair of hinge plates to form a second knuckle, with a second hinge pin received within the second knuckle to define a second axis of rotation different from and spaced from the first axis of rotation. An actuator arm operably couples to the first hinge assembly and the second hinge assembly. The actuator arm is operable between a first fixed state, where the actuator arm positions the first hinge pin within the first knuckles defining a first axis of rotation and the second hinge pin is withdrawn from the second knuckle, and a second fixed state, where the actuator arm positions the second hinge pin within the second knuckles defining the second axis of rotation and the first hinge pin is withdrawn from the first knuckle. The door assembly stays in one of the first fixed state and the second fixed state throughout its operation until the other of the first fixed state and the second fixed state is actuated.

In yet another aspect, the disclosure relates to a method of actuating a dual-axis door for a household appliance having a first hinge assembly defining a first axis of rotation for the door and a second hinge assembly defining a second axis of rotation for the door. The method includes fixedly disengaging one of the first or second hinge assemblies when the door is rotated about the other of the corresponding second or first axes of rotation; and fixedly engaging the other of the first or second hinge assemblies when the door is rotated about the one of the corresponding first or second axes of rotation.

DETAILED DESCRIPTION

Traditionally, appliance doors, such as a laundry treating appliance, have a single axis of pivoting rotation, permitting opening of the door in a single direction. On occasion, the direction that the door opens is undesirable. One example would include where a washer and dryer combination have one or both doors that open towards one another, substantially blocking the path for transferring laundry between the two. One additional exemplary factor that can lead to undesirable opening directions for the doors can include the environment in which the appliance is installed; such as adjacent to a wall. Therefore, there is a need for a door that can open in more than one direction to permit opening in desired direction.

The present disclosure details a door link assembly provided in a door for an appliance permitting opening of the door in two directions about two axes. The door link assembly is actuable with two handle selectors to select the desired opening direction. Using the handle selectors unlocks the door from the appliance along one axis and locks the door to the appliance about the remaining axis, in order to permit opening in the selected direction, while preventing the door from separating at the remaining axis. Therefore, selective actuation of the handle selector can determine the direction of opening, providing the consumer with two options.

A "set" as described herein can include any number of components, including only one component. For example, a set of pins in contemplated to include one or more pins. The term "leaf" or "leaves" as used herein means a plate or mount element coupled to one or more knuckles, for mounting a portion of a hinge assembly. "Leaf" or "leaves" can be used interchangeably with "plate" or "hinge plate."

Figure 1:
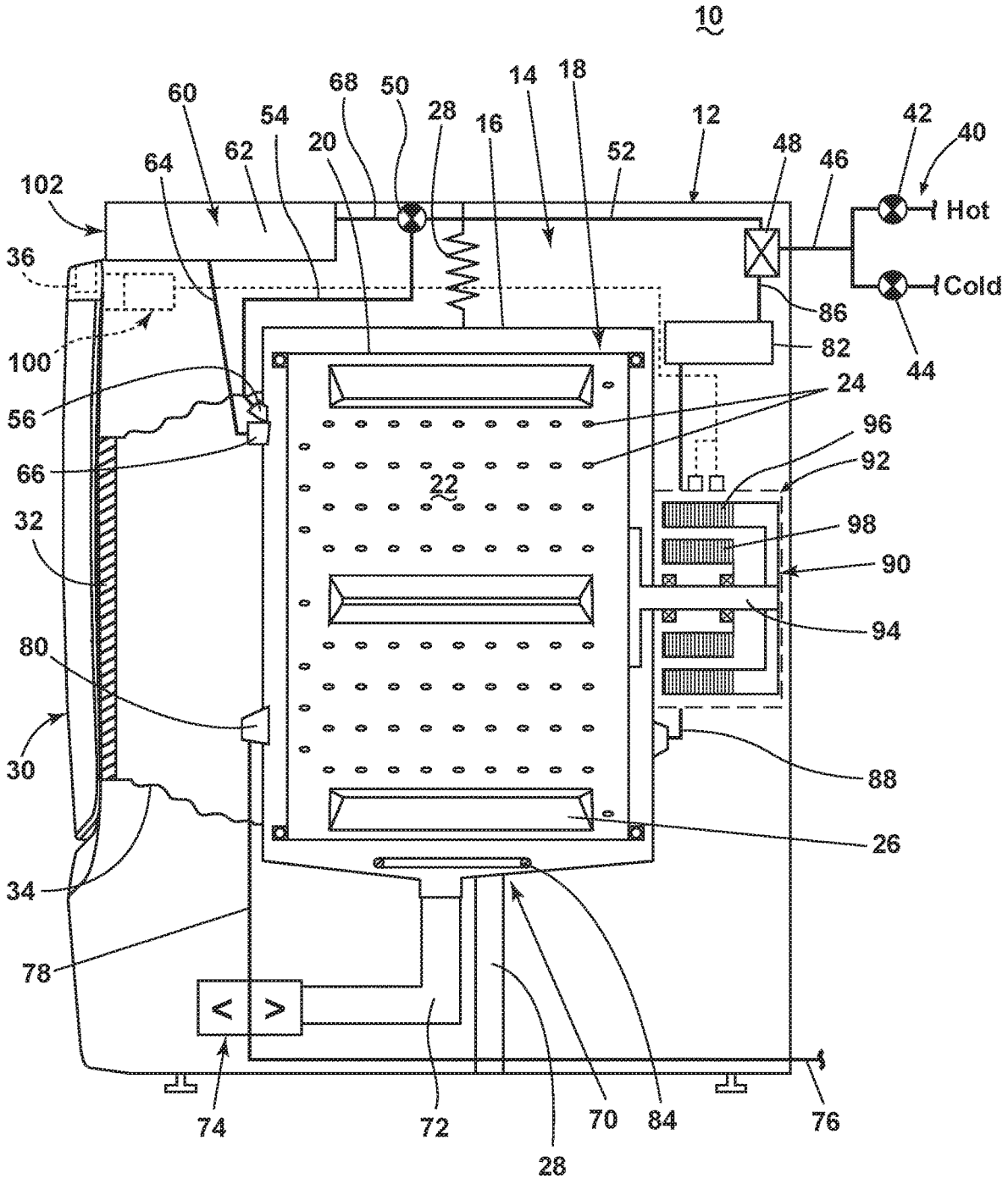
FIG. 1 is a schematic view of a laundry treating appliance in the form of a washing machine having a bi-directional door assembly.

Referring now to FIG. 1, a laundry treating appliance can be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. Furthermore, while described herein as a laundry treating appliance, the door assembly as detailed herein can be applied to any suitable appliance where a bi-directional door would be desirable. The laundry treating appliance is illustrated as an exemplary washing machine 10, which can include a structural support system including a cabinet or chassis 12, which defines a housing within which a laundry holding system resides. The chassis 12 can be a housing or a frame, defining an interior 14 enclosing components typically found in a conventional washing machine, such as motors, pumps, fluid lines, controls, sensors, transducers, and the like.

The laundry holding system includes a tub 16 supported within the chassis 12. A liquid chamber 18 can be defined by the tub 16. A drum 20 is provided within the tub 14 and defines a treating chamber 22. The drum 20 can include a plurality of perforations 24 such that liquid can flow between the tub 16 and the drum 20 through the perforations 24. A plurality of laundry movers 26 can be disposed on an inner surface of the drum 20 to lift the laundry load received in the treating chamber 22 while the drum 20 rotates. It is also within the scope of the invention for the laundry holding system to comprise only a tub with the tub defining the laundry treating chamber. A suitable suspension system 28, such as a spring, can suspend the tub 16 within the chassis 12.

The laundry holding system can further include a door 30 movably mounted to the chassis 12 to selectively close both the tub 16 and the drum 20 at an access opening 32 formed in the chassis 12. The access opening 32 can include a first side and a second side, such as the left side and the right side of the access opening 32. A bellows 34 can couple between the access opening 32 of the chassis 12 and the tub 16 sealing the interior 14 at the access opening 32. A handle 36 can be provided on the door 30 for moving the door 30 relative to the chassis 12.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 16 by controlling first and second diverter valves 48 and 50. The first diverter mechanism 48 can direct the flow of liquid to a supply conduit 52 and the second diverter mechanism 50 can direct the flow of liquid to a tub outlet conduit 54, which can include a spray nozzle 56, configured to spray the flow of liquid into the tub 16. In this manner, water from the household water supply 40 can be supplied directly to the tub 16.

The washing machine 10 can also include a dispensing system 60 for dispensing treating chemistry to the treating chamber 22 according to a cycle of operation. The dispensing system 60 can include a dispenser 62, which can be any suitable single use dispenser, a bulk dispenser, or a combination thereof and can be configured to dispense a treating chemistry directly to the tub 16 or mixed with water from the liquid supply system through a dispensing outlet conduit 64. The dispensing outlet conduit 64 can include a dispensing nozzle 66 configured to dispense the treating chemistry into the tub 16. Water can be supplied to the dispenser 62 from the supply conduit 52 by directing the diverter mechanism 50 to direct the flow of water to a dispensing supply conduit 68.

The washing machine 10 can further include a recirculation and drain system for recirculating liquid within the laundry holding system and draining liquid from the washing machine 10. Liquid supplied to the tub 16 through the tub outlet conduit 54 and/or the dispensing supply conduit 68 typically enters a space between the tub 16 and the drum 20 and can flow by gravity to a sump 70 formed in part by a lower portion of the tub 16. The sump 70 can also be formed by a sump conduit 72 that fluidly couples the lower portion of the tub 16 to a pump 74. The pump 74 can direct liquid to a drain conduit 76 to drain the liquid or to a recirculation conduit 78, which can terminate at a recirculation inlet 80 where liquid can be recirculated into the tub 16 or the drum 20.

The liquid supply and/or recirculation and drain system can be provided with a heating system such as a steam generator 82 and a heater 84. Liquid from the household water supply 40 can be provided to the steam generator 82 to direct the flow of liquid to a steam supply conduit 86 to supply steam to the tub 14 through a steam outlet conduit 88. Alternatively, the heater 84 can be used to generate steam in place of the steam generator 82. In addition, the steam generator 82 and the heater 84 can be used to heat the laundry and/or liquid within the tub 16 as part of a cycle of operation. It is contemplated that the liquid supply, recirculation, and drain systems can differ from the configuration as shown, such as by inclusion of other valves, conduits, treating chemistry dispensers, sensors, such as water level sensors and temperature sensors, and the like.

The washing machine 10 also includes a drive system 90 for rotating the drum 20 within the tub 16. The drive system 90 can include a motor 92, which can directly couple with the drum 20 by a drive shaft 94 to rotate the drum 20 about a rotational axis according to a cycle of operation in one, either, or both directions at variable speeds. In one example, the motor 92 can be a brushless permanent magnet (BPM) motor having a stator 96 and a rotor 98. Other motors, such as an induction motor or a permanent split capacitor (PSC) motor, or any other suitable motor can be used.

The washing machine 10 also includes a control system for controlling the operation of the washing machine 10 to implement one or more cycles of operation. The control system can include a controller 100 located within the chassis 12 and a user interface 102 that is operably coupled with the controller 100. The user interface 102 can include one or more knobs, dials, switches, displays, touch screens and the like for communicating with the user, such as to receive input and provide output. The user can enter different types of information including, without limitation, cycle selection and cycle parameters, such as cycle options.

The controller 100 can include the machine controller and any additional controllers provided for controlling any of the components of the washing machine 10. For example, the controller 100 can include the machine controller and a motor controller. It is contemplated that the controller is a microprocessor-based controller that implements control software and sends/receives one or more electrical signals to/from each of the various working components to effect the control software.

Figure 2:
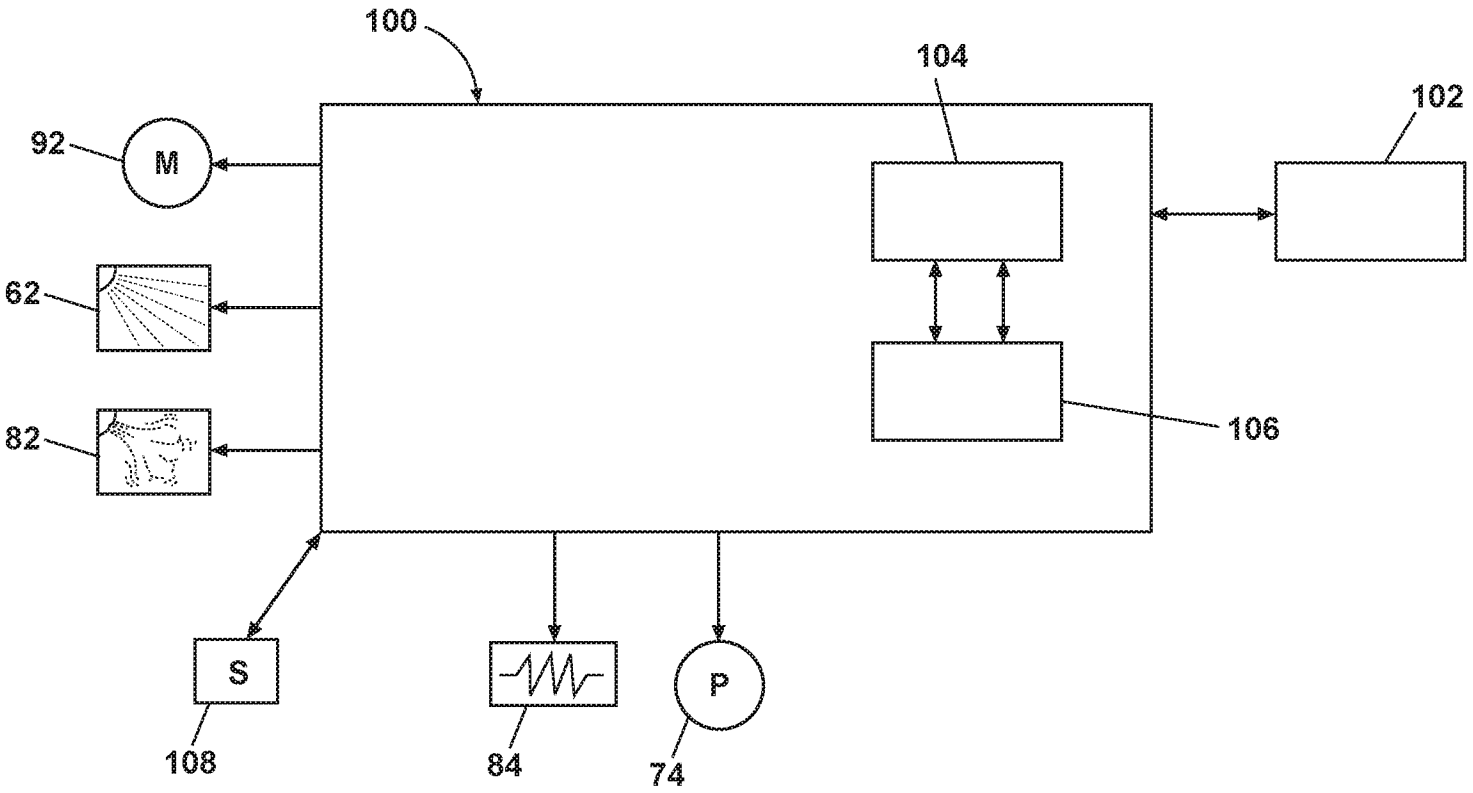
FIG. 2 is a schematic of a control system of the laundry treating appliance of FIG. 1.

Referring now to FIG. 2, the controller 100 can be provided with a memory 104 and a central processing unit (CPU) 106. The memory 104 can be used for storing the control software that is executed by the CPU 106 in completing a cycle of operation using the washing machine 10 and any additional software. The memory 104 can also be used to store information, such as a database or table, and to store data received from one or more components of the washing machine 10 communicable to the controller 100.

The controller 100 can be operably coupled with one or more components of the washing machine 10 for communicating with and controlling the operation of the component to complete a cycle of operation. For example, the controller 100 can be operably coupled with the motor 92, the pump 74, the dispenser 62, the steam generator 82, and the heater 84 to control the operation of these and other components to implement one or more of the cycles of operation.

The controller 100 can couple with one or more sensors 108 provided in one or more of the systems of the washing machine 10 to receive input from the sensors. Exemplary sensors 108 can include a treating chamber temperature sensor, a moisture sensor, a weight sensor, a chemical sensor, a position sensor, or a motor torque sensor.

Figure 3:
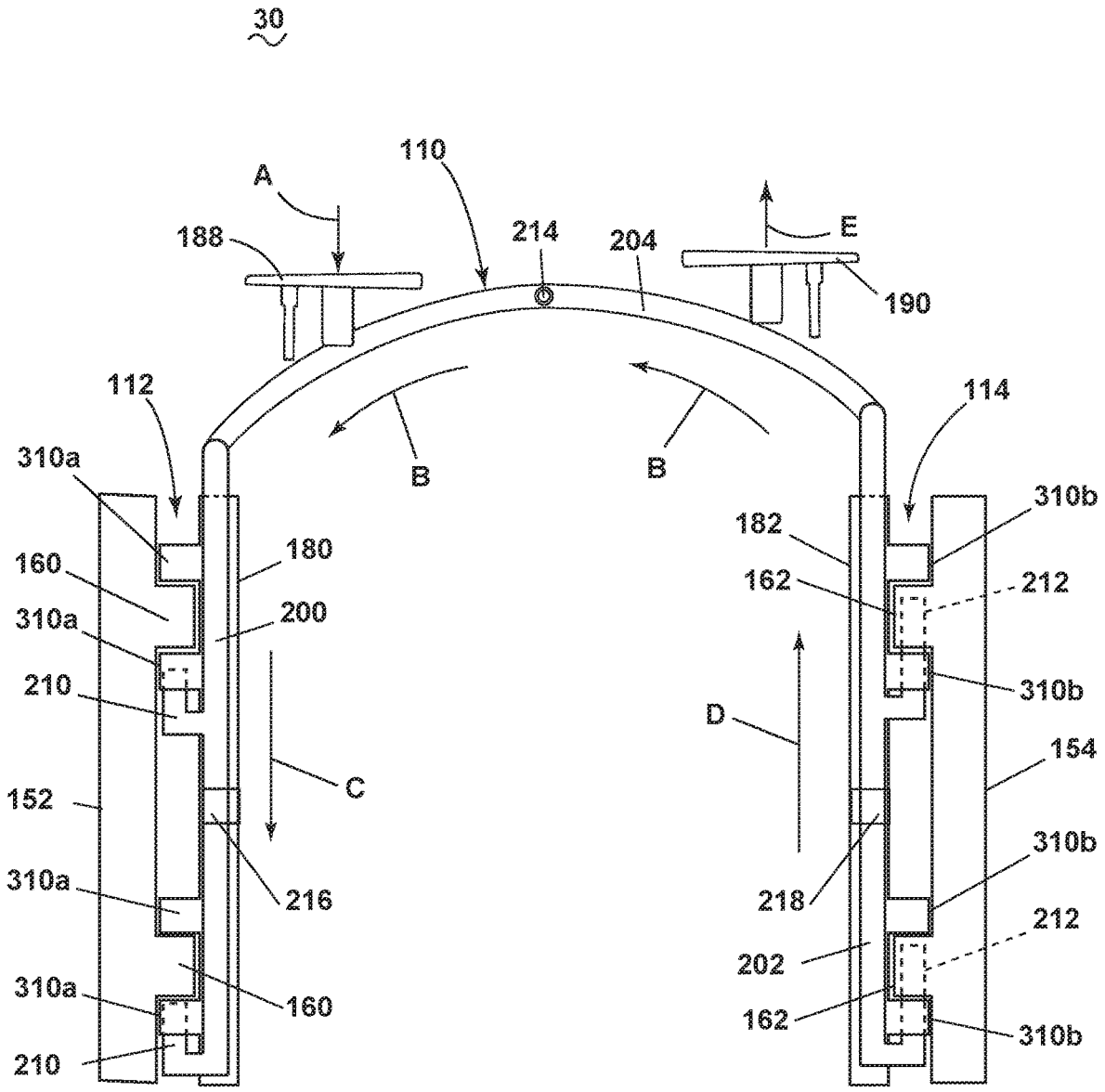
FIG. 3 is a schematic overview of the bi-directional door assembly of FIG. 1 including a first hinge assembly, a second hinge assembly, and an actuator arm.

Referring now to FIG. 3, the door 30 can include a bi-directional actuator assembly 110 having a first hinge assembly 112 and a second hinge assembly 114 forming a first axis of rotation and a second axis of rotation, respectively. An actuator arm 204 is pivotable about a joint 214. A first actuator 188 and a second actuator 190 couple to the actuator arm 204. The first hinge assembly 112 includes a first leaf 152, a second leaf 180, a first knuckle 160 coupled to the first leaf 152, and a second knuckle 310*a* coupled to the second leaf 180. The first hinge assembly 112*a* further includes a first pin arm 200 coupled to the second leaf 180 and includes a first set of pins 210. A first retainer assembly 216 couples to the first hinge assembly 112.

The second hinge assembly 112 includes a third leaf 182, a fourth leaf 154, a fourth knuckle 162 coupled to the third leaf 182, and a third knuckle 310*b* coupled to the fourth leaf 154. The second hinge assembly 114 further includes a second pin arm 202 coupled to the third leaf 182, and includes a second set of pins 212. A second retainer assembly 218 couples to the second hinge assembly 114.

In operation, the first and second actuators 188, 190 can be actuated to pivot the actuator arm 204 about the joint 214. Actuation of the first actuator 188 in a downward direction, as illustrated by arrow A, pivots the actuator arm 204 in a counter-clockwise direction, as illustrated by arrow B. The pivoting movement of the actuator arm 204 moves the first pin arm 200 downward, as illustrated by arrow C, disengaging the first pin 210 from the first knuckle 160, which permits separation of the first and second leaves 152, 180. Therefore, the first hinge assembly 112 is oriented in the disengaged position, permitting opening of the door 30 at the first hinge assembly 112.

Simultaneously, the pivoting movement of the actuator arm 204 moves the second pin arm 202 upward, as illustrated by arrow D, inserting the second pin 212 into the fourth knuckle 162 to permit pivoting movement of the door 30 about the second hinge assembly 114. In such a position, the second hinge assembly 114 is oriented in the engaged position.

Therefore, the actuator arm 204 can move the first hinge assembly 112 and the second hinge assembly 114 between a first fixed state and a second fixed state. The first fixed state can include that the first set of pins 210 are received within the first and second knuckles 160, 310*a* and the second set of pins 212 are withdrawn from the third and fourth knuckles 310*b*, 162. The second fixed state can include that the first set of pins 210 are withdrawn from the first and second knuckles 160, 310*a*, and the second set of pins 212 are received within the third and fourth knuckles 310*b*, 162. As shown in FIG. 3 as the bi-directional actuator assembly 110 is oriented in the second fixed state.

The first and second retainer assemblies 216, 218 can bias and secure the first and second hinge assemblies 112, 114 in the disengaged and engaged positions, respectively. The first and second hinge assemblies 112, 114 remain in the respective disengaged and engaged positions until actuation of the second actuator 190. Actuating of the second actuator 190 pivots the actuator arm 204 in the clockwise direction, engaging the pin 210 in the first hinge assembly 112 in the engaged position, and removing the pin 212 in the second hinge assembly 114 in the disengaged position. Similarly, the first and second retainer assemblies 216, 218 can bias and secure the first and second hinge assemblies 112, 114 in the engaged and disengaged positions until actuation of the first actuator 188. The first and second retainer assemblies can fix the actuator arm 204 or the bi-directional actuator assembly 110 in the first or second fixed states throughout operation until the other of the first and second fixed states is actuated.

Figure 4:
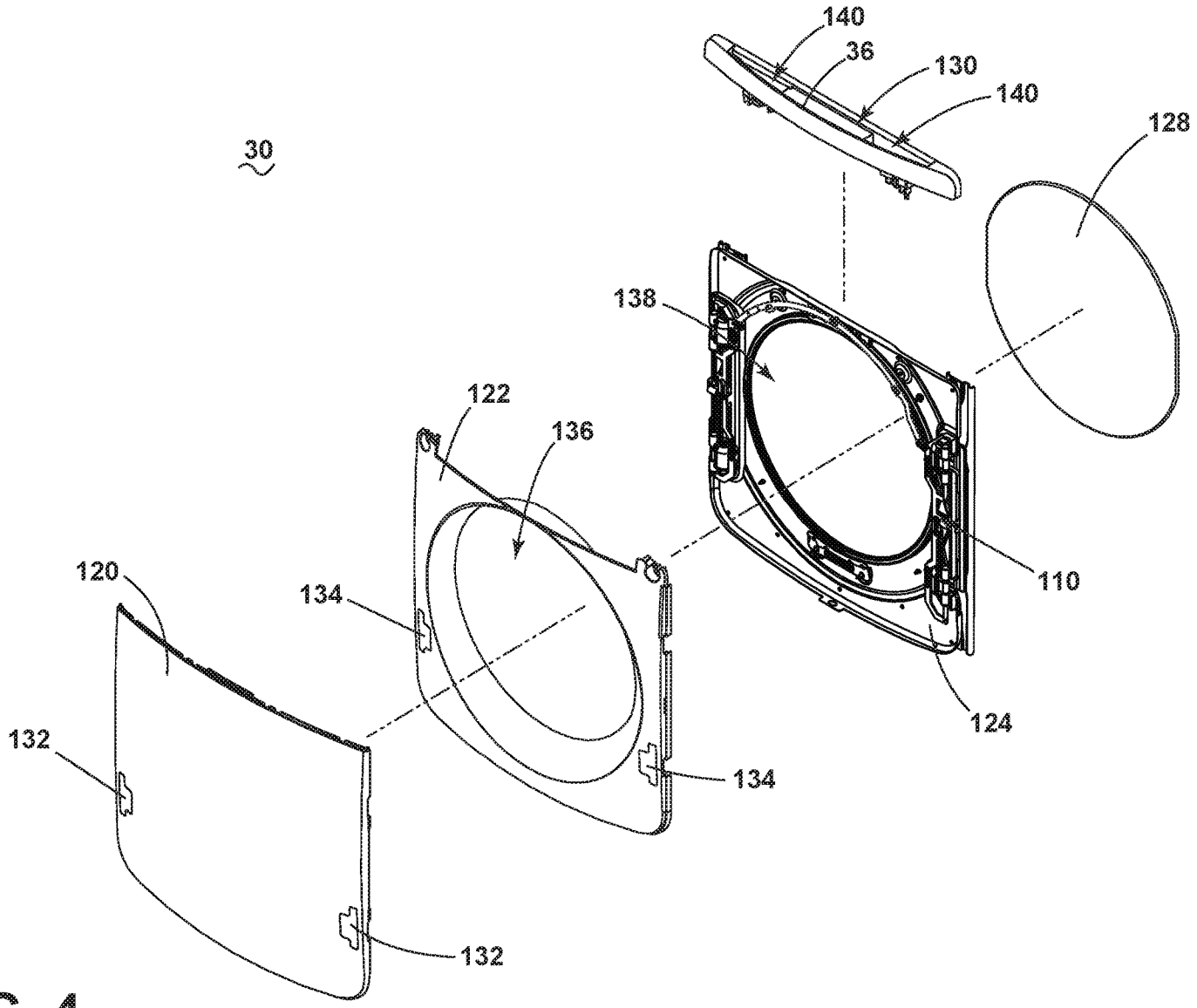
FIG. 4 is an exploded view of the bi-directional door assembly of FIG. 1 including a door link assembly attached to a rear mount plate.

Referring now to FIG. 4, the door 30 can include a cover plate 120, a front mount plate 122, a rear mount plate 124 carrying the bi-directional actuator assembly, a rear pane 128, and a handle assembly 130. The cover plate 120 includes a first set of hinge apertures 132. The cover plate 120 is configured to couple to the front mount plate 122 to provide a finished front for the door 30. The cover plate 120 can be transparent or translucent, permitting visual inspection of the interior of the washing machine 10 through the door 30. The front mount plate 122 includes a second set of hinge apertures 134 complementary to the first set of hinge apertures 132, such that coupling of the cover plate 120 to the front mount plate 122 aligns the first and second sets of hinge apertures 132, 134. A first central opening 136 is provided in the front mount plate 122, and can be sized complementary to the access opening 32 of the chassis 12.

The combined cover plate 120 and the front mount plate 122 can couple to the rear mount plate 124, positioning the bi-directional actuator assembly 110 between the front and rear mount plates 122, 124. Portions of the bi-directional actuator assembly 110 can position within the first and second set of hinge apertures 132, 134, permitting pivoting movement of the door about the bi-directional actuator assembly 110 within the first and second set of hinge apertures 132, 134. A second central opening 138 can be provided in the rear mount plate 124, and can be sized complementary to the first central opening 136, for example. The rear pane 128 can couple within the second central opening 138 to enclose the first and second central openings 136, 138 in the door 30. The rear pane 128 can be transparent or translucent, similar to that of the cover plate 120.

The handle assembly 130 can couple to the tops of the front mount plate 122 and the rear mount plate 124, enclosing the gap between the mount plates 122, 124 at the top of the door 30. The handle assembly 130 can form the handle 36 for the door 30, as well as including handle openings 140 providing access for a user to actuate the bi-directional actuator assembly 110 at the handle assembly 130.

Figure 5:
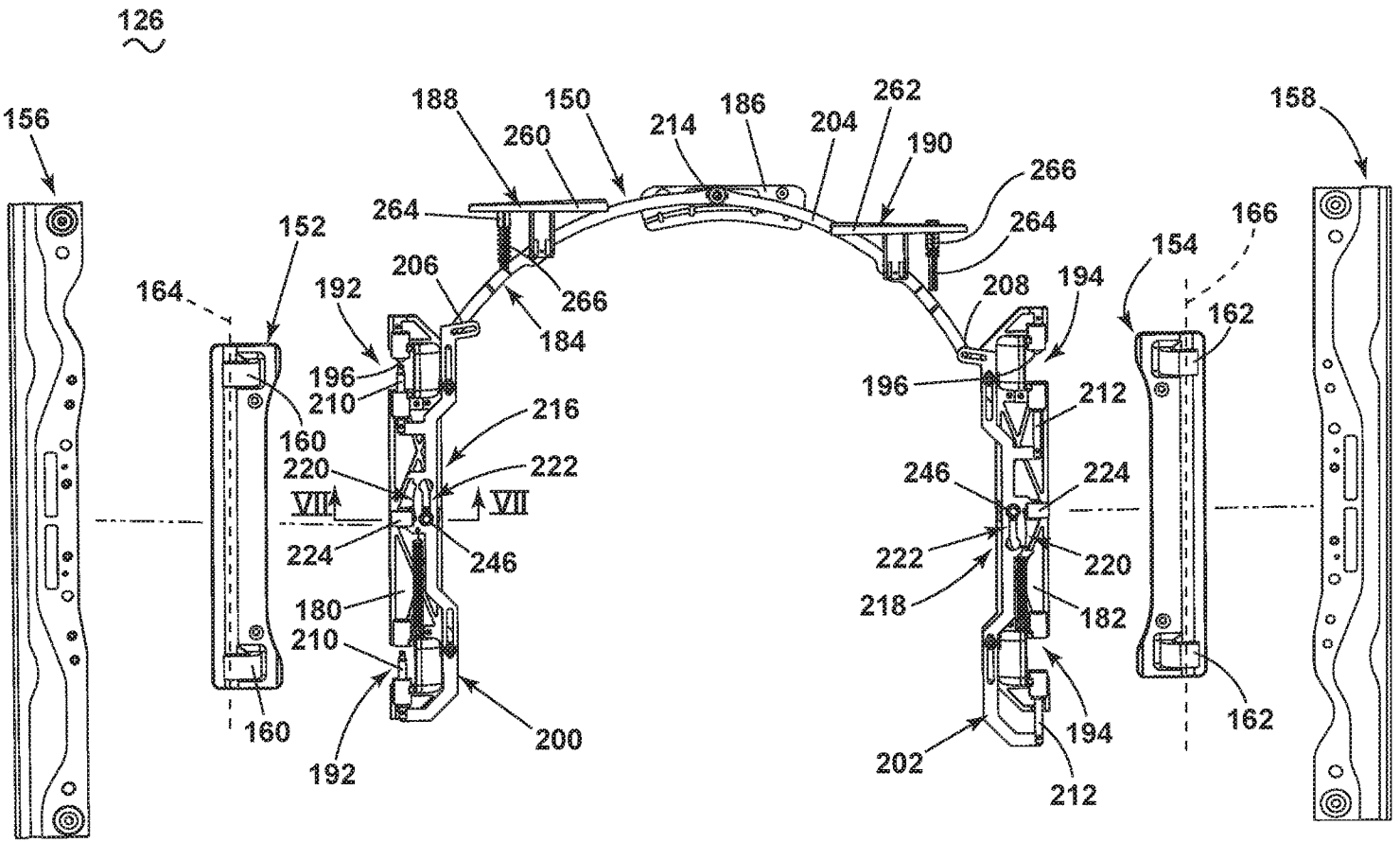
FIG. 5 is an exploded view of the door link assembly of FIG. 4, including a hinge assembly.

Referring now to FIG. 5, the bi-directional actuator assembly 110 is exploded better showing a hinge assembly 150 separated from the first leaf 152, the fourth leaf 154, a left mount plate 156, and a right mount plate 158. The exploded view shows the hinge assembly 150 oriented in the first fixed state. The left mount plate 156 and right mount plates 158 are adapted to couple to the first leaf 152 and the fourth leaf 154, respectively. The left and right mount plates 156, 158 are configured to mount to the rear mount plate 124 of FIG. 4, for coupling the first and fourth leaves 152, 154 to the chassis 12.

The first leaf 152 includes the first knuckles 160 and the right pivot plate includes the fourth knuckles 162, with the first and fourth knuckles 160, 162 each having a cylindrical shape with a central opening adapted to form a portion of a hinge configured to accept a pin. The first leaf 152 can define a left pivot axis 164 passing through the first knuckles 160 and the fourth leaf 154 can define a right pivot axis 166 extending through the fourth knuckles 162. In operation, the door 30 can pivot to open the access opening 32 relative to the chassis 12 about the left and right pivot axes 164, 166, based upon actuation of the hinge assembly 150, discussed in detail below.

The hinge assembly 150 can include the second leaf 180, the third leaf 182, a hinge arm assembly 184, a pivot mount 186, the first actuator 188, and the second actuator 190. The second leaf 180 can include a set of left knuckle openings 192 adapted to receive the first knuckles 160 to orient the left pivot axis 164 along the left knuckle openings 192. Similarly, the third leaf 182 can include a set of right knuckles openings 194 adapted to receive the fourth knuckles 162 to orient the right pivot axis 166 along the right knuckle openings 194. A catch 196 can be provided extending into the left and right knuckle openings 192, 194, adapted to form a catch-lock assembly with the first and fourth knuckles 160, 162 inserted into knuckles openings 192, 194. The catch-lock assemblies prevent the door from opening without an opening force provided by a user.

The hinge arm assembly 184 can be three-part, including the first pin arm 200, the second pin arm 202, and the actuator arm 204 coupled to the first pin arm 200 at a first end 206 and coupled to the second pin arm 202 at an opposing second end 208. The actuator arm 204 pivotably couples to the pivot mount 186 at the joint 214, and can pivot relative to the joint 214. The actuator arm 204 can be actuable to move the first pin arm 200 and the second pin arm 202 relative to the second leaf 180 and the third leaf 182, respectively. The first pin arm 200 includes a set of first hinge pins 210 and the second pin arm 202 includes a set of second hinge pins 212. The first pin arm 200 can be movably coupled to the second leaf 180 aligning the first hinge pins 210 with the left knuckle openings 192. The second pin arm 202 can be movably coupled to the third leaf 182 aligning the second hinge pins 212 with the right knuckle openings 194. Therefore, when the second and third leaves 180, 182 are aligned with the first and fourth leaves 152, 154, the first and second hinge pins 210, 212 can be actuable into the first and fourth knuckles 160, 162, pivotable along the left and right pivot axes 164, 166.

The retainer assemblies 216, 218 can include a biasing assembly 220 and can be provided on the first and second pin arms 200, 202, interconnected with the second and third leaves 180, 182. A biased pin 224 can at least partially form the biasing assembly 220, and can be two biased pins 224, with one coupled to each of the second and third leaves 180, 182, configured to bias the first and second pin arms 200, 202. Additionally, the retainer assemblies 216, 218 can include a lock assembly 222 can include a lock pin 246 adapted to lock movement of the first and second pin arms 200, 202 relative to the second and third leaves 180, 182.

The first and the second actuators 188, 190 are shown as an exemplary left paddle 260 and a right paddle 262 coupled to the actuator arm 204. The first and second actuators 188, 190 can be formed as part of the handle assembly 130 of FIG. 4, and can also be formed as part of the hinge assembly 150. The left and right paddles 260, 262 can be operable to actuate the actuator arm 204 by depressing the paddles 260, 262. While shown and described herein as paddles 260, 262, the actuators 188, 190 can be any suitable operable member designed to actuate the actuator arm 204 in order to actuate the first and second pin arms 200, 202. The left and right paddles 260, 262 can further include a finger 264 with a spring 266 arranged on the finger 264. The spring 266 can be used with the finger 264 to provide a spring force to facilitate movement of one of the left and right paddles 260, 262 in an engaged position so that the paddles 260, 262 cannot become stuck between an engaged and disengaged position.

Figure 6:
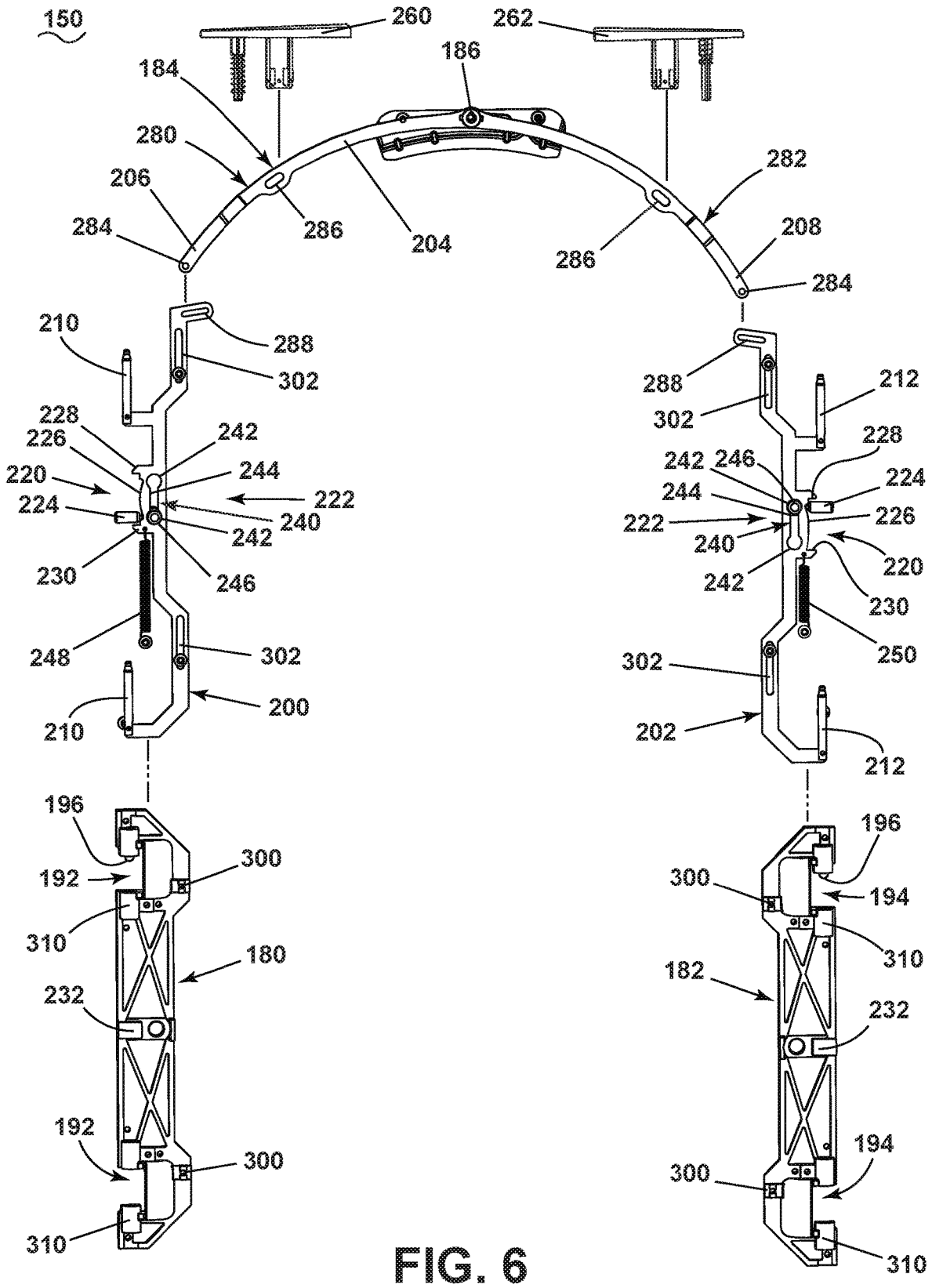
FIG. 6 an exploded view of the hinge assembly of FIG. 5.

Referring now to FIG. 6, the actuator arm 204 can include a first set of apertures 286 adapted to couple to the left and right paddles 260, 262 where actuation of the paddles 260, 262 can pivot the actuator arm 204 about the pivot mount 186.

The actuator arm 204 can include a set of arm apertures 284 at the opposing ends 206, 208. The first pin arm 200 and the second pin arm 202 can each include an actuator aperture 288, adapted to receive a fastener to couple the first and second pin arms 200, 202 to the actuator arm 204 at the arm apertures 284. The actuator apertures 288 can be elongated, permitting the pivoting movement of the actuator arm 204, while actuating the first and second pin arms 200, 202 in a substantially linear direction. Therefore, pivoted movement of the actuator arm 204 can be translated to the first and second pin arms 200, 202 at the opposing ends 206, 208.

The second and third leaves 180, 182 can each include a set of fastener openings 300. The first pin arm 200 and the second pin arm 202 can each include a set of elongated openings 302. The first and second pin arms 200, 202 can fasten to the second and third leaves 180, 182 with any suitable fastener, permitting the first and second pin arms 200, 202 to slidably actuate relative to the second and third leaves 180, 182 along the elongated openings 302.

The second and third leaves 180, 182 can each also include the second and third knuckles 310 positioned along the knuckle openings 192, 194 and spaced from the catch 196 for forming the catch-lock assemblies. The pins 210, 212 of the first and second pin arms 200, 202 slidably move along the second and third knuckles 310 to extend into or retract from the knuckle openings 192, 194 respective of movement from the first and second pin arms 200, 202.

The biasing assembly 220 with the lock assembly 222 can be included on each of the first pin arm 200 and the second pin arm 202 for biasing movement and locking movement of the pin arms 200, 202 relative to the second and third leaves 180, 182. The biasing assembly 220 includes the biased pin 224 aligned along a rounded edge 226 of each of the first and second pin arms 200, 202. The rounded edge 226 can terminate at a first end 228 and a second end 230 such that the biased pin 224 can pass along the rounded edge 226 between the first end 228 and the second end 230. The biased pin 224 can affix in a seat 232 on the second and third leaves 180, 182 such that actuation of the first and second pin arms 200, 202 slides the biased pin 224 along the rounded edges 226. The biasing assembly 220 can further include a left spring 248 coupled between the second leaf 180 and the first pin arm 200 and a right spring 250 coupled between the third leaf 182 and the second pin arm 202 in order to bias the biased pin 224 toward or from either of the first or second ends 228, 230.

The lock assembly 222 includes a slot 240 formed in each of the first and second pin arms 200, 202, having opposing ends 242 with channel 244 extending between the ends 242. The ends 242 can be enlarged, having a diameter that is greater than the width of the channel 244. The ends 242 can be positioned adjacent to first end 228 and the second end 230 of the rounded edge 226. The lock pin 246 can couple to each of the second leaf 180 and the third leaf 182, such that each of the first pin arm 200 and the second pin arm 202 can slide relative to the second and third leaves 180, 182 along the channels 244 relative to the lock pins 246.

Figure 7:
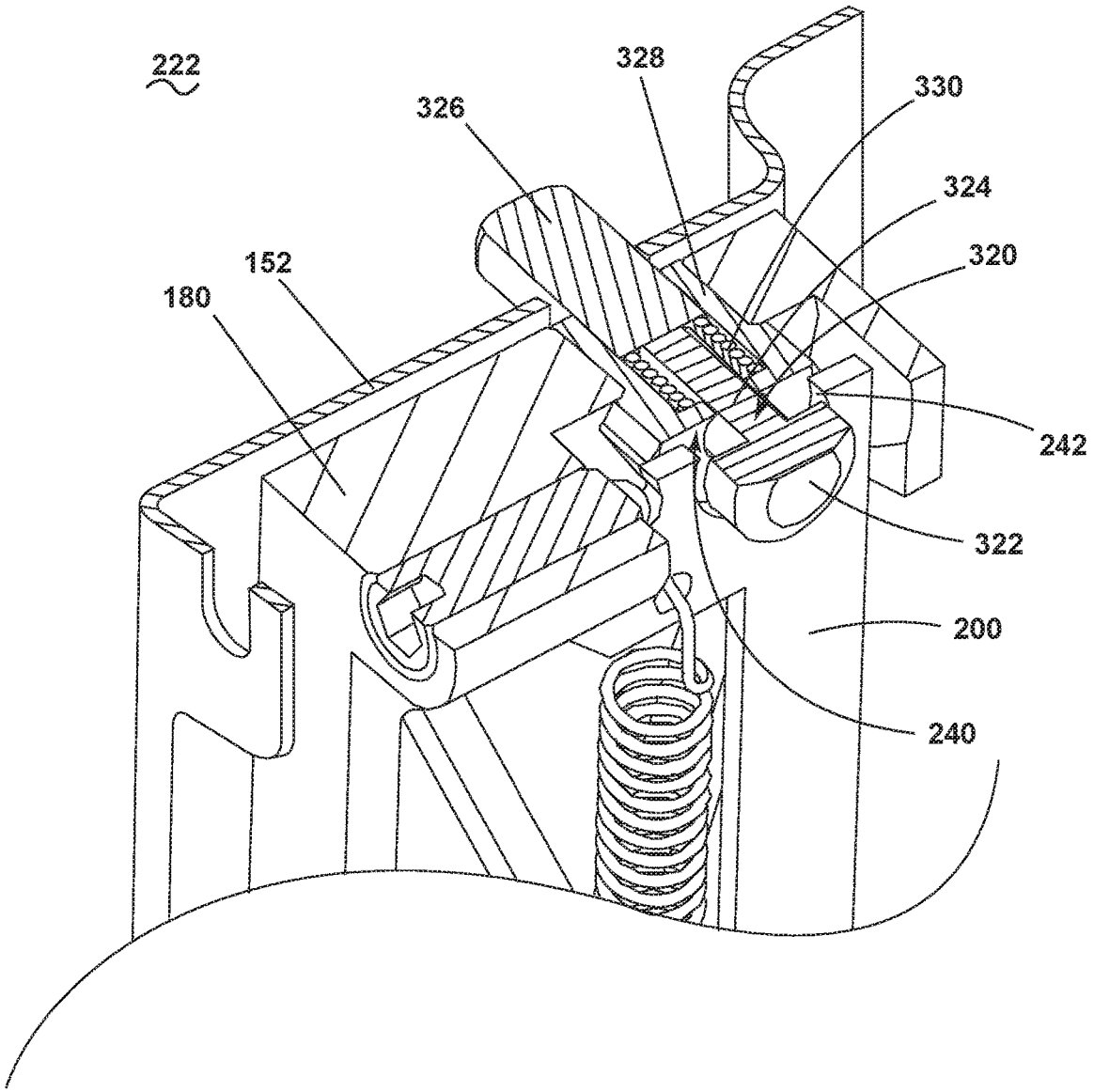
FIG. 7 is a section view of a lock assembly taken across sections VI-VI of FIG. 5.

Referring now to FIG. 7, showing a section taken along section VI-VI of FIG. 5, shows the lock assembly 222 extending through the first leaf 152, the second leaf 180, and the first pin arm 200. The lock assembly 222 includes a pin 320 having an enlarged head 322 and a body 324. A portion of the body 324 can be coupled to a base 326 and housed within a housing 328, each coupled to the second leaf 180. A spring 330 is provided around the body 324 between the housing 328 and the base 326. The pin 320 is actuable relative to the housing 328, biased by the spring 330, and limited by the head 322 and actuable at the base 326.

The head 322 is sized to fit into both of the ends 242 of the slot 240 in the first pin arm 200, while is too wide to fit into the channel 244. Therefore, the spring 330 is actuable to move the pin 320 inward to insert the head 322 into the end 242 in order to lock the first pin arm 200 relative to the second leaf 180 when the door 30 is opened. In such a way, the lock assembly 222 prevents actuation of the pin arms 200, 202 relative to the second and third leaves 180, 182. When the door 30 closes, the base 326 abuts the chassis 12, and actuators the head 322 out of the end 242 to permit sliding movement of the lock assembly 222 along the slot 240.

Figure 8:
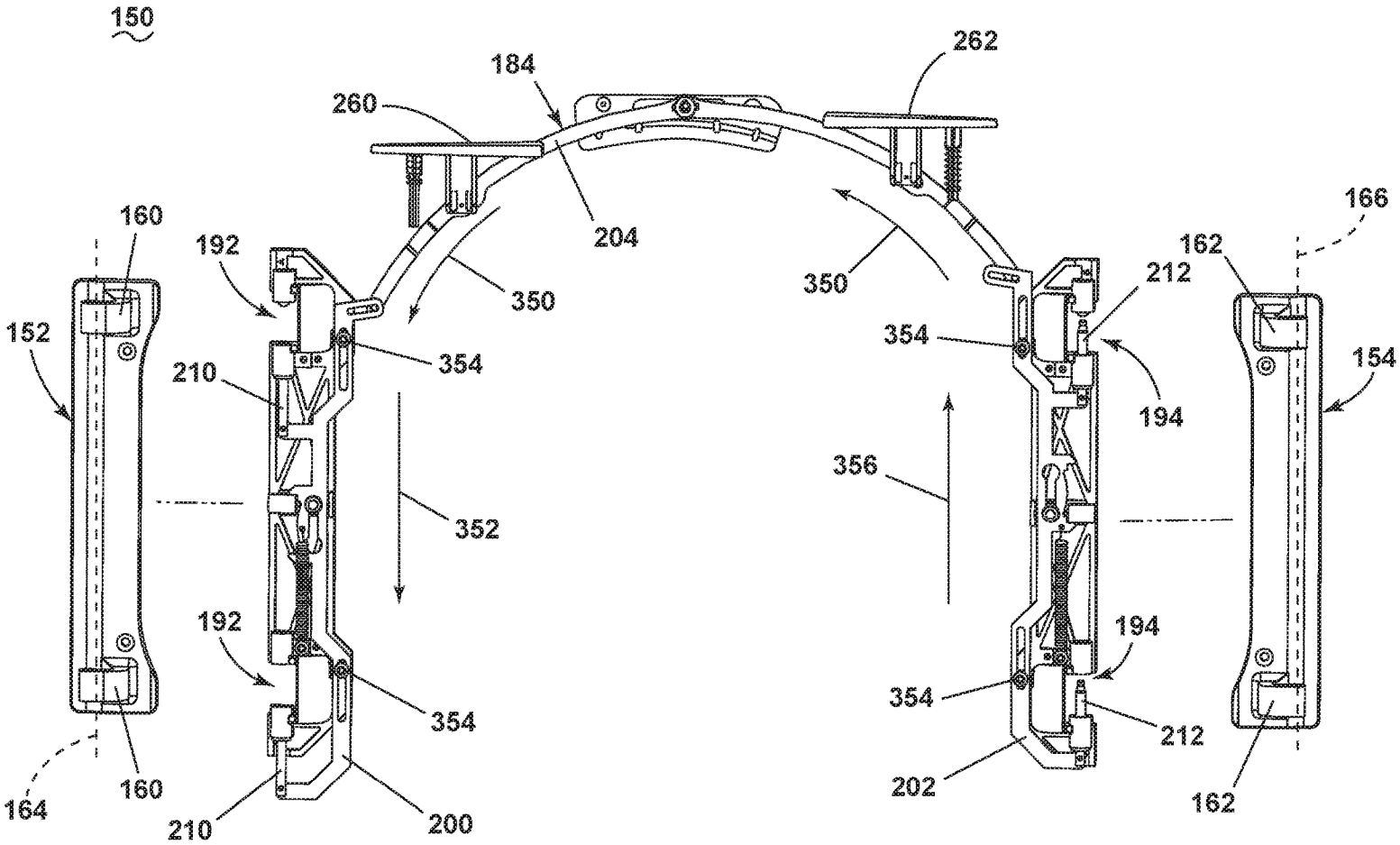
FIG. 8 is a front view of the door link assembly of FIG. 5 with a second handle actuated to orient a first hinge assembly in an engaged position and a second hinge assembly in a disengaged position.

Referring now to FIG. 8, showing the hinge assembly 150 in the second fixed state, the left paddle 260 has been actuated, such as depressed by a user. Depression of the left paddle 260 pivots the actuator arm 204 in a counter-clockwise direction, as illustrated by arrow 350. Pivoting of the actuator arm 204 by depressing the left paddle 260 causes the first pin arm 200 to actuate and move downward, as illustrated by arrow 352, sliding the elongated openings 302 of the first pin arm 200 along fasteners 354 secured in the fastener openings 300 of the second leaf 180. In sliding the first pin arm 200 downward, illustrated by arrow 352, the first hinge pins 210 are moved out of the left knuckle openings 192, and would not be secured within the first knuckle 160 of the first leaf 152. Therefore, the hinge assembly 150 would not be secured to the first leaf 152, permitting separation of the hinge arm assembly 184 from the first leaf 152.

Additionally, depression of the left paddle 260 pivots the actuator arm 204 in the counter-clockwise direction, as illustrated by arrow 350, to cause the second pin arm 202 to actuate and move upward, as illustrated by arrows 356. Upward movement of the second pin arm 202 causes the hinge pins 212 to move into the right knuckle openings 194, coupling the hinge arm assembly 184 to the fourth leaf 154 and into the engaged position at the fourth knuckles 162. In the engaged position, the hinge assembly 150 is pivotably coupled to the chassis 12, permitting the door 30 to pivot about the right pivot axis 166, and open in a left-to-right direction.

Figure 9:
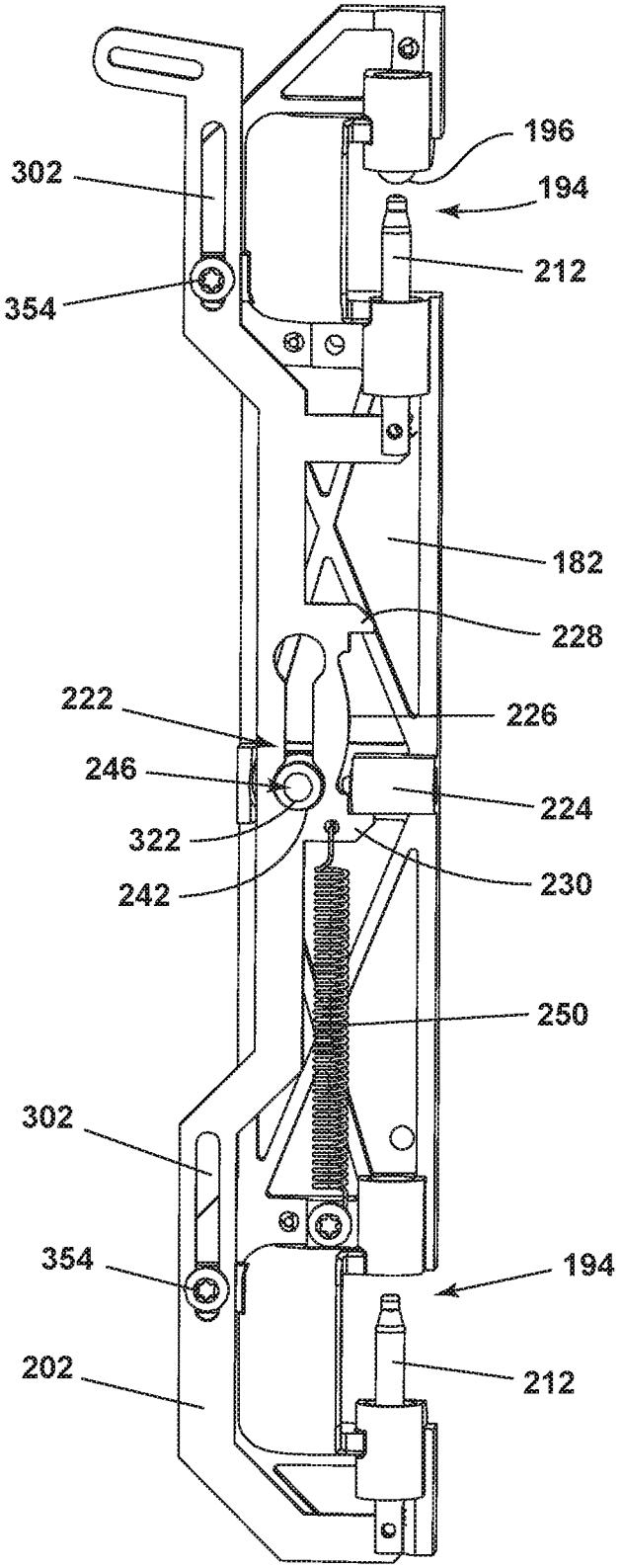
FIG. 9 is an enlarged view of the hinge assembly of FIG. 8 having a portion oriented in the engaged position.

Referring now to FIG. 9, an enlarged view of the third leaf 182 with the second hinge arm 202 of FIG. 8 is positioned in the engaged position. The fasteners 354 are positioned at the bottom of the elongated openings 302 with the second pin arm 202 moved upward. The second hinge pins 212 are also moved upward, positioning in the right knuckle openings 194, slightly spaced from the catch 196.

The biased pin 224 on the third leaf 182 is actuated to the second end 230 at the bottom of the rounded edge 226. The spring 250 provides a tuned spring force to bias the second pin arm 202, in addition to the geometry of the rounded edge 226, to minimize or eliminate the occurrence of the second pin arm 202 becoming stuck between the disengaged and engaged positions. Specifically, it is desirable that the biased pin 224 does not become positioned in the middle of the rounded edge 226, between the first and second ends 228, 230, where the door 30 can become stuck and cannot open in any direction.

The lock assembly 222 on the third leaf 182 then locks the second pin arm 202 in the engaged position, locking the second hinge pins 212 extending into the right knuckle openings 194 and, therefore, within the fourth knuckles 162. The lock pin 246 has the head 322 positioned at the bottom end 242, where the head 322 can lock within the bottom end 242. Positioning the head 322 within the bottom end 242 prevents the second pin arm 202 from moving relative to the third leaf 182, effectively locking the second pin arm 202 in the engaged position. Actuation of the paddles 260, 262 of FIG. 8 can actuate the lock pin 246 to push the head 322 outwardly, out of the end 242, unlocking the lock assembly 222 and permitting movement of the second pin arm 202 relative to the third leaf 182.

Figure 10:
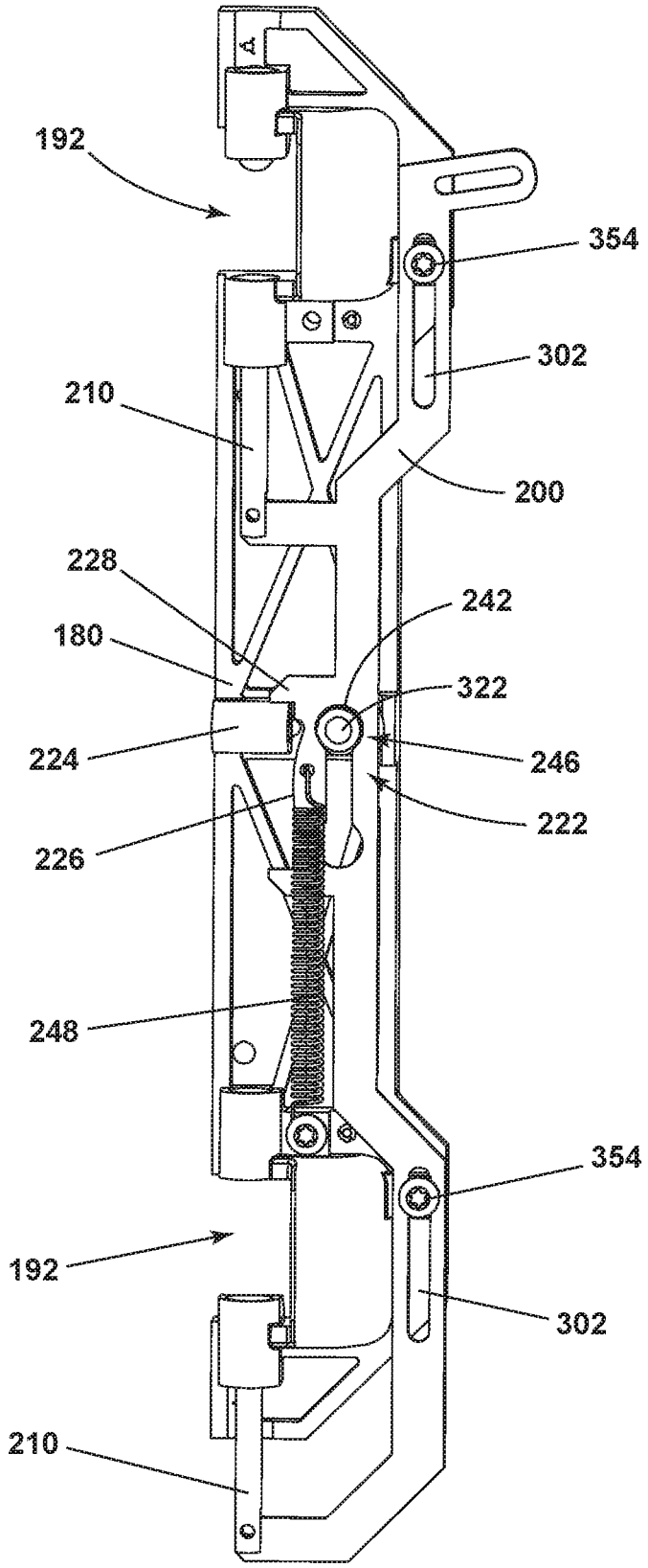
FIG. 10 is another enlarged view of the hinge assembly of FIG. 8 having another portion oriented in the disengaged position.

Referring now to FIG. 10, showing the hinge assembly 150 in the first fixed state, an isolated view of the second leaf 180 with the first pin arm 200 of FIG. 8 is positioned in the disengaged position. The fasteners 354 are positioned at the top of the elongated openings 302 with the first pin arm 200 moved downward. The first hinge pins 210 are moved downward, positioned outside of the left knuckle openings 192.

The biased pin 224 on the second leaf 180 is actuated to the first end 228 at the top of the rounded edge 226. The spring 248 provides a spring force to bias the first pin arm 200 with the rounded edge 226 to minimize or eliminate the first pin arm 200 becoming stuck between the disengaged or engaged positions. The spring force can be tuned such that the spring 248 does not overcome the rounded edge 226 without the assistance of a user actuating the paddles 260, 262.

The lock assembly 222 on the second leaf 180 locks the first pin arm 200 in the disengaged position, locking the first hinge pins 210 exterior of the left knuckle openings 192. The lock pin 246 has the head 322 positioned at the top end 242, where the head 322 can position within the top end 242. Positioning the head 322 within the upper end 242 prevents the first pin arm 200 from moving relative to the second leaf 180, effectively locking the first pin arm 200 in the disengaged position. Actuation of the paddles 260, 262 of FIG. 8 can actuate the lock pin 246 to push the head 322 outwardly, permitting movement of the first pin arm 200 relative to the second leaf 180.

Figure 11:
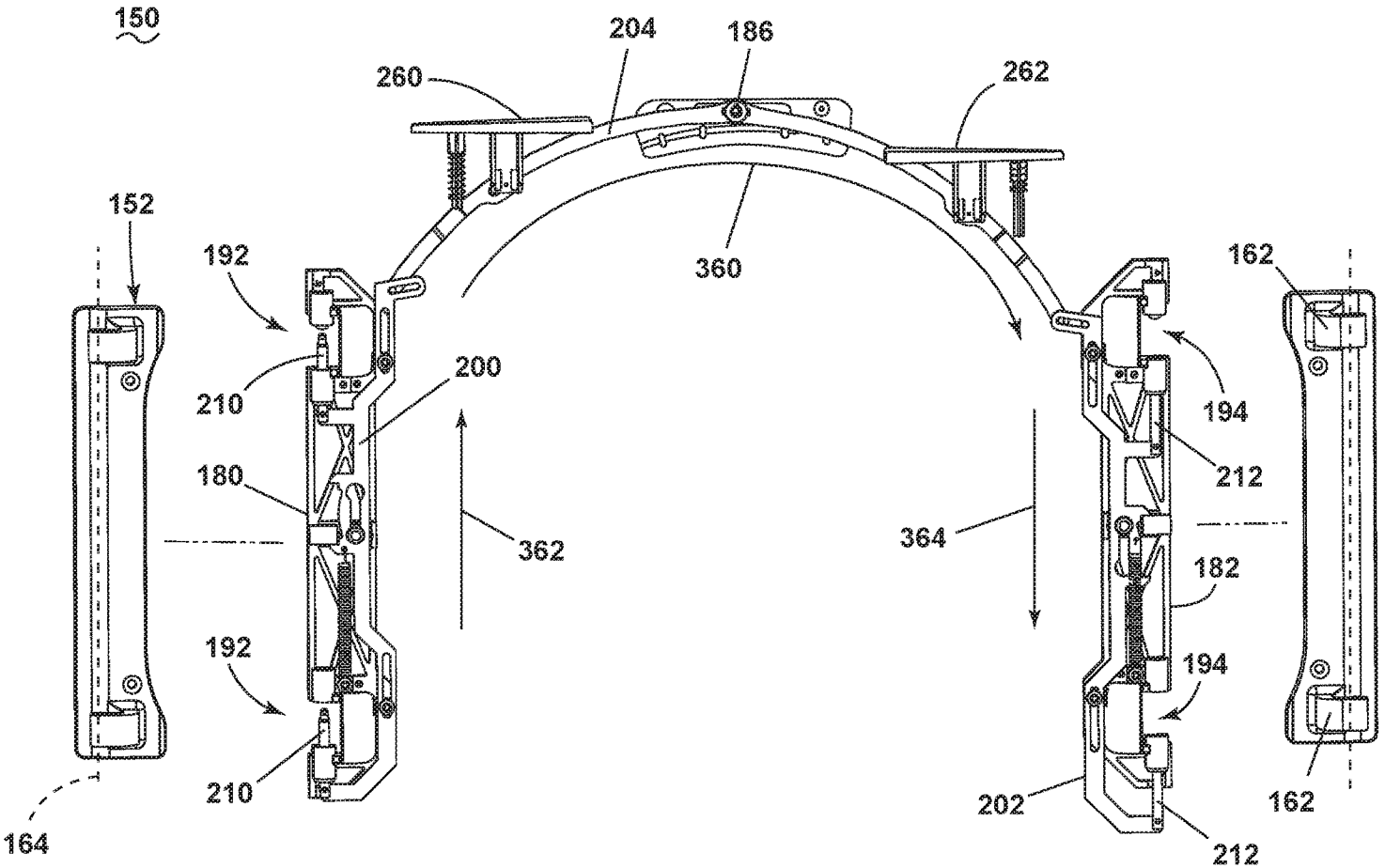
FIG. 11 is a front view of the door link assembly of FIG. 5 with a first handle actuated to orient the second hinge assembly in the engaged position and the first hinge assembly in the disengaged position.

Referring now to FIG. 11, an exploded view of the hinge assembly 150 illustrates the right paddle actuated 262, causing the actuator arm 204 to pivot about the pivot mount 186 in the clock-wise direction, as illustrated by arrow 360. The first pin arm 200 has been moved upward, as illustrated by arrow 362, by movement of the actuator arm 204 to position the first hinge pins 210 within the left knuckle openings 192. Actuating the first hinge pins 210 into the left knuckles openings 192 can couple the second leaf 180 to the first leaf 152, permitting pivoting movement of the door 30 about the left pivot axis 164, such that the door can be opened from right-to-left.

Simultaneously, the second pin arm 202 has been actuated downward, as illustrated by arrow 364, by movement of the actuator arm 204 to position the second hinge pins 212 exterior of the right knuckles openings 194, permitting separation of the fourth knuckles 162 from the right knuckles openings 194 in order to open the door 30 at the right side.

It should be understood that the bi-directional actuator assembly 110 as described herein provides for opening of the door 30 for an appliance in two directions, about two pivoting axes. In operation, actuation of the left paddle 260 moves the left pin arm 200 to unlink the first hinge pins 210 from the first knuckles 160. Simultaneously, the second pin arm 202 is moved to link the second hinge pins 212 into the fourth knuckles 162 in order to permit the door to pivot about the second pins 212. In that manner, the door 30 is unlinked at the left side, and linked at the right side, permitting opening of the door 30 from a left-to-right direction.

Additionally, actuator of the right paddle 262 actuates the first pin arm 200 to link the first hinge pins 210 at the first knuckles 160, and unlink the second hinge pins 212 at the fourth knuckles 162, permitting opening of the door 30 in a right-to-left direction. Therefore, desired directional opening of the door 30 from either left-to-right, or right-to-left is permitted by actuation of either the left or right paddle 260, 262.

Furthermore, the first and second pin arms 200, 202 can be locked into place by the lock assemblies 222, preventing unlinking of the door at both the first and fourth knuckles 160, 162, preventing the door 30 from being removed from the chassis 12 by actuation of the paddles 260, 262 alone. Further still, the springs 248, 250, in combination with the biasing assembly 220, biases the paddles 260, 262 in either direction, to prevent or minimize the occurrence of the paddles 260, 262 and the bi-directional actuator assembly 110 becoming positioned between a disengaged and an engaged position on either side.

A method of actuating a dual-axis door for a household appliance having a first hinge assembly 112 defining a first axis of rotation 164 for the door 30 and a second hinge assembly 114 defining a second axis of rotation 166 for the door 30, the method comprising fixedly disengaging one of the first or second hinge assemblies 112, 114 when the door 30 is rotated about the other of the corresponding second or first axes of rotation 164, 166, and fixedly engaging the other of the first or second hinge assemblies 112, 114, when the door 30 is rotated about the one of the corresponding second or first axis of rotation 164, 166.

Actuating the first actuator 188 can move the actuator arm 204 to move the first hinge assembly 112 into the disengaged position and the second hinge assembly 114 into the engaged position, as shown in FIGS. 3 and 8. Actuating the second actuator 190 can pivot the actuator arm 204 can orient the first hinge assembly 112 in the engaged position and the second hinge assembly 114 in the disengaged position, as shown in FIG. 11. The first or second retainer assemblies 216, 218 can be used to retainer the first and second hinge assemblies 112, 114 in the engaged and disengaged positions. Only actuation of the opposing actuator 188, 190 can release the retainers to vary the orientation of the engaged and disengaged positions.

Furthermore, the method can include biasing with a biasing assembly 220 either the first or second hinge assemblies 112, 114 to be fixedly disengaged. Additionally, the method can include locking with a locking assembly 222 the other of the first or second hinge assemblies 112, 114 to be fixedly engaged.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A household appliance comprising:

a chassis defining an interior having an access opening;

a door selectively closing the access opening;

a first hinge assembly comprising a first pair of hinge plates mounted to the chassis and door, respectively, and collectively forming a first knuckle, with a first hinge pin received within the first knuckle to define a first axis of rotation for the door;

a second hinge assembly comprising a second pair of hinge plates mounted to the chassis and door, respectively, and collectively forming a second knuckle, with a second hinge pin received within the second knuckle to define a second axis of rotation for the door, which is different from and spaced from the first axis of rotation; and an actuator arm, pivotable about a pivot point between a first position and a second position, and coupled to both the first and second hinge pins and operable between a first fixed state, where the actuator arm is pivoted to the first position, the first hinge pin is received within the first knuckle and the second hinge pin is withdrawn from the second knuckle, and a second fixed state, where the actuator arm is pivoted to the second position, the second hinge pin is received within the second knuckle, and the first hinge pin is withdrawn from the first knuckle, wherein the actuator arm stays in one of the first and second positions throughout its operation until the other of the first and second fixed states is actuated.

2. The household appliance of claim 1 further comprising a first actuator and a second actuator coupled to the actuator arm.

3. The household appliance of claim 2 wherein actuation of the first actuator orients the actuator arm in the second fixed state.

4. The household appliance of claim 3 wherein actuation of the second actuator orients the actuator arm in the first fixed state.

5. The household appliance of claim 1 wherein the first hinge assembly includes a first pin arm coupled to the actuator arm carrying the first hinge pin and the second hinge assembly includes a second pin arm coupled to the actuator arm carrying the second hinge pin.

6. The household appliance of claim 5 wherein the first pin arm and the second pin arm are operably coupled to the actuator arm.

7. The household appliance of claim 6 wherein the first pin arm is actuable to move the first hinge pin between the first fixed state and the second fixed state.

8. The household appliance of claim 1 wherein the first axis of rotation and the second axis of rotation are parallel to one another.

9. The household appliance of claim 1 wherein the door is pivotable about one of the first axis of rotation or the second axis of rotation to access the interior.

10. The household appliance of claim 1 further comprising a first retainer assembly coupled to the first hinge assembly and a second retainer assembly coupled to the second hinge assembly, wherein the first retainer assembly is configured to fix the actuator arm in the first fixed state and the second retainer assembly is configured to fix the actuator arm in the second fixed state.

11. The household appliance of claim 10 wherein the first retainer assembly comprises a first biasing assembly and the second retainer assembly comprises a second biasing assembly, with both of the first biasing assembly and the second biasing assembly each including a spring configured to bias either of the first hinge assembly or the second hinge assembly into the first fixed state or the second fixed state, respectively.

12. The household appliance of claim 11 wherein each of the first retainer assembly and the second retainer assembly further include a lock assembly to secure either the first hinge assembly and the second hinge assembly in the first fixed state or the second fixed state, respectively.

13. The household appliance of claim 12 wherein the lock assembly is unlocked when the door is positioned to close the access opening.

14. A door assembly for a household appliance having a chassis including an access opening, the door assembly comprising:

a first hinge assembly comprising a first pair of hinge plates forming a first knuckle, with a first hinge pin received within the first knuckle to define a first axis of rotation;

a second hinge assembly comprising a second pair of hinge plates forming a second knuckle, with a second hinge pin received within the second knuckle to define a second axis of rotation different from and spaced from the first axis of rotation; and an actuator arm, pivotable between a first position and a second position, and operably coupled to the first hinge assembly and the second hinge assembly;

wherein the actuator arm is operable between a first fixed state, where the actuator arm positions the first hinge pin within the first knuckle defining the first axis of rotation and the second hinge pin is withdrawn from the second knuckle, and a second fixed state, where the actuator arm positions the second hinge pin within the second knuckle defining the second axis of rotation and the first hinge pin is withdrawn from the first knuckle, and the door assembly stays in one of the first fixed state and the second fixed state throughout its operation until the other of the first fixed state and the second fixed state is actuated.

15. The door assembly of claim 14 further comprising a first actuator and a second actuator operably coupled to the actuator arm configured to actuate the actuator arm between the first fixed state and the second fixed state.

16. The door assembly of claim 14 wherein the first hinge assembly includes a first pin arm carrying the first hinge pin and the second hinge assembly includes a second pin arm carrying the second hinge pin.

17. The door assembly of claim 16 wherein the actuator arm is actuable to actuate the first pin arm and the second pin arm between the first fixed state and the second fixed state.

* * * * *